US010085320B1

(12) United States Patent
Sussman

(10) Patent No.: US 10,085,320 B1
(45) Date of Patent: Sep. 25, 2018

(54) PRE-CALIBRATED LIGHT BOX

(71) Applicant: Peter Sussman, St. Louis Park, MN (US)

(72) Inventor: Peter Sussman, St. Louis Park, MN (US)

( * ) Notice: Subject to any disclaimer, the term of this patent is extended or adjusted under 35 U.S.C. 154(b) by 0 days.

(21) Appl. No.: 15/787,982

(22) Filed: Oct. 19, 2017

Related U.S. Application Data

(60) Provisional application No. 62/411,116, filed on Oct. 21, 2016.

(51) Int. Cl.

| | |
|---|---|
| ***H05B 33/08*** | (2006.01) |
| ***G09F 13/00*** | (2006.01) |
| ***G09F 13/20*** | (2006.01) |
| *F21Y 113/00* | (2016.01) |

(52) U.S. Cl.
CPC ..... *H05B 33/0869* (2013.01); *G09F 13/005* (2013.01); *G09F 13/20* (2013.01); *H05B 33/0827* (2013.01); *H05B 33/0857* (2013.01); *F21Y 2113/00* (2013.01)

(58) Field of Classification Search
CPC ..... H05B 33/0812; H05B 33/0842; H05B 35/00; H05B 37/0218; H05B 33/0827; H05B 33/083; H05B 33/0857; H05B 33/086; F21Y 2115/10; F21Y 2113/00; G01J 3/0254; G01J 3/501
See application file for complete search history.

(56) References Cited

U.S. PATENT DOCUMENTS

| | | | | |
|---|---|---|---|---|
| 7,354,172 | B2 * | 4/2008 | Chemel | H05B 33/0842 362/231 |
| 7,967,652 | B2 * | 6/2011 | Emerson | H01L 25/0753 313/498 |
| 8,115,779 | B2 * | 2/2012 | Ackermann | H05B 33/086 345/589 |
| 8,194,095 | B2 * | 6/2012 | Imai | G09G 5/02 345/590 |
| 8,222,652 | B2 * | 7/2012 | Harrah | H05B 33/086 257/89 |

(Continued)

OTHER PUBLICATIONS

Edaphic Scientific, "LED binning explained", http://www.edaphic.com.au/knowledge-base/articles/light-articles/led-binning-explained/, at least as early as Oct. 9, 2017, 7 pages.

*Primary Examiner* — Vibol Tan
(74) *Attorney, Agent, or Firm* — Leanne Taveggia Farrell; Westman, Champlin & Koehler, P.A.

(57) ABSTRACT

A pre-calibrated light box includes a light panel, a material attached to the light panel and at least one LED strip positioned inside the light box and including a plurality of interweaved LEDs selected from three different bins on a chromaticity diagram. The three different bins are selected based on plotting a representative vertex inside each of the first, the second and the third bins and drawing a triangle between the vertices so that a target color of white light emitted out of the light box is located inside the drawn triangle. At least three channels are electrically coupled to each of the bins of LEDs and each channel powers the corresponding bin of LEDs with a proportion of power determined by a geometric location of the target color of white light with respect to a location of each of the bins on the chromaticity diagram.

8 Claims, 10 Drawing Sheets

(56) References Cited

U.S. PATENT DOCUMENTS

| | | | | |
|---|---|---|---|---|
| 8,333,631 | B2 * | 12/2012 | Emerson | H01L 25/0753 313/503 |
| 8,339,029 | B2 * | 12/2012 | Kim | F21K 9/00 313/498 |
| 8,339,541 | B2 * | 12/2012 | Lee | G02B 6/0068 345/102 |
| 8,378,958 | B2 * | 2/2013 | Chen | G09G 3/3426 345/102 |
| 8,495,871 | B2 * | 7/2013 | Bitter | E02F 9/2235 60/443 |
| 8,755,911 | B2 * | 6/2014 | Baaijens | H05B 33/0863 315/307 |
| 8,928,249 | B2 * | 1/2015 | Raj | H05B 33/0869 315/153 |
| 9,198,251 | B2 * | 11/2015 | Ter Weeme | H05B 33/0863 |
| 9,234,801 | B2 * | 1/2016 | Mei | G01J 3/463 |
| 9,696,005 | B2 * | 7/2017 | Holland | F21V 5/007 |
| 9,807,843 | B2 * | 10/2017 | Koo | H05B 33/0866 |
| 2015/0262979 | A1 * | 9/2015 | Yamauchi | H01L 25/0753 362/231 |

* cited by examiner

PRE-CALIBRATED LIGHT BOX

CROSS-REFERENCE TO RELATED APPLICATION

The present application is based on and claims the benefit of U.S. provisional patent application Ser. No. 62/411,116, filed Oct. 21, 2016, the content of which is hereby incorporated by reference in its entirety.

BACKGROUND

Light panels or light boxes display illuminated graphics or images in locations of high traffic, such as retail stores. Light panels or light boxes may include a substrate, such as translucent acrylic or other material, for applying a graphic or image, electric lights, such as LEDs, so as to provide lighting for even illumination of a graphic or image and a light guide panel, such as glass or acrylic. Example configurations of light panels or boxes include back light to illuminate the front side or edge-lit lighting to illuminate the front side.

LED edge-lit graphic displays include side channels housing a strip of one or more LEDs, a light guide panel, such as a panel made of acrylic, and in some cases, but not all cases a graphic. The LEDs must be placed adjacent to the ends of the light guide panel so that light from the LEDs travels through the ends of the acrylic and evenly illuminates the graphic that is located adjacent to a front surface of the acrylic.

The discussion above is merely provided for general background information and is not intended to be used as an aid in determining the scope of the claimed subject matter.

SUMMARY

A pre-calibrated light box includes a filter including a light panel and a material attached to the light panel that is configured to receive a graphic and a plurality of white LEDs positioned inside the light box and selected from three different color bins located on a chromaticity diagram. The three different bins of LEDs are selected based on plotting a representative vertex located inside each of the first, the second and the third bins and drawing a triangle between the vertices so that a target color of white light to be emitted from the light box is located inside the drawn triangle. A controller includes at least three channels such that a first channel is electrically coupled to the first bin of the white LEDs, a second channel is electrically coupled to the second bin of the white LEDs and a third channel is electrically coupled to the third bin of the white LEDs. Each channel powers the corresponding bin of the white LEDs with a proportion of power determined for each channel by the location of the target color of white light on the chromaticity diagram with respect to the location of each of the selected first, second and third color bins on the chromaticity diagram so as to achieve emission of the target color of white light from the light box.

A method of pre-calibrating a light box to emit a target color of white light. The method includes selecting a plurality of white LEDs from three different color bins on a chromaticity diagram such that each selection is based on plotting a representative vertex in each of the three color bins and drawing a triangle between the three vertices so that a target color of white light to be emitted from the light box is located inside the plotted triangle. The selected plurality of white LEDs from the three different color bins are used inside the light box. A proportion of power is supplied to each of the first, second and third color bins of white LEDs as determined by the location of the target color of white light with respect to a location of each of the selected first, second and third color bins on the chromaticity diagram.

A pre-calibrated light box includes a light panel, a material attached to the light panel that is configured to receive a graphic and at least one LED strip positioned inside the light box and including a plurality of interweaved LEDs selected from three different bins on a chromaticity diagram. The three different bins of LEDs are selected based on plotting a representative vertex inside each of the first, the second and the third bins and drawing a triangle between the vertices so that a target color of white light to be emitted out of the light box is located inside the drawn triangle. At least three channels are electrically coupled to each of the first bin of LEDs, the second bin of LEDs and the third bin of LEDs. Each channel powers the corresponding bin of LEDs with a proportion of power determined by a geometric location of the target color of white light on the chromaticity diagram with respect to a location of each of the selected first, second and third bins on the chromaticity diagram so as to achieve emission of the target color of white light from the light box.

DETAILED DESCRIPTION OF ILLUSTRATIVE EMBODIMENTS

Pre-calibrated light boxes described herein produce a target color of white light located on an International CIE (Commission on Illumination) chromaticity diagram by selecting and mixing three different ANSI color bins of white light LEDs and determining the proportional amount of power that is delivered to the three different ANSI color bins of white light LEDs. In particular, white light LEDs from the three different ANSI color bins are interweaved on LED strip(s) to mix the three different ANSI color bins of white light LEDs together and then located in a light box. While the three different bins of LEDs are interweaved, each of the first group, second group and third group of LEDs are electrically connected to a different channel of a controller so that each group of ANSI color bins are powered by one of three channels. In this way, the amount of power delivered to each of the three groups of ANSI color bins is set to produce a target color of white light on the CIE chromaticity diagram.

Colorimetery is the science of the human perception of color and is defined by the key concepts of color space or a way to objectively describe perceptible color, empirical data and models of human perception and variability in color and vision. Based on the perception of color by the human eye, the most common model used is the International Commission on Illumination (CIE) color space.

Figure 1:
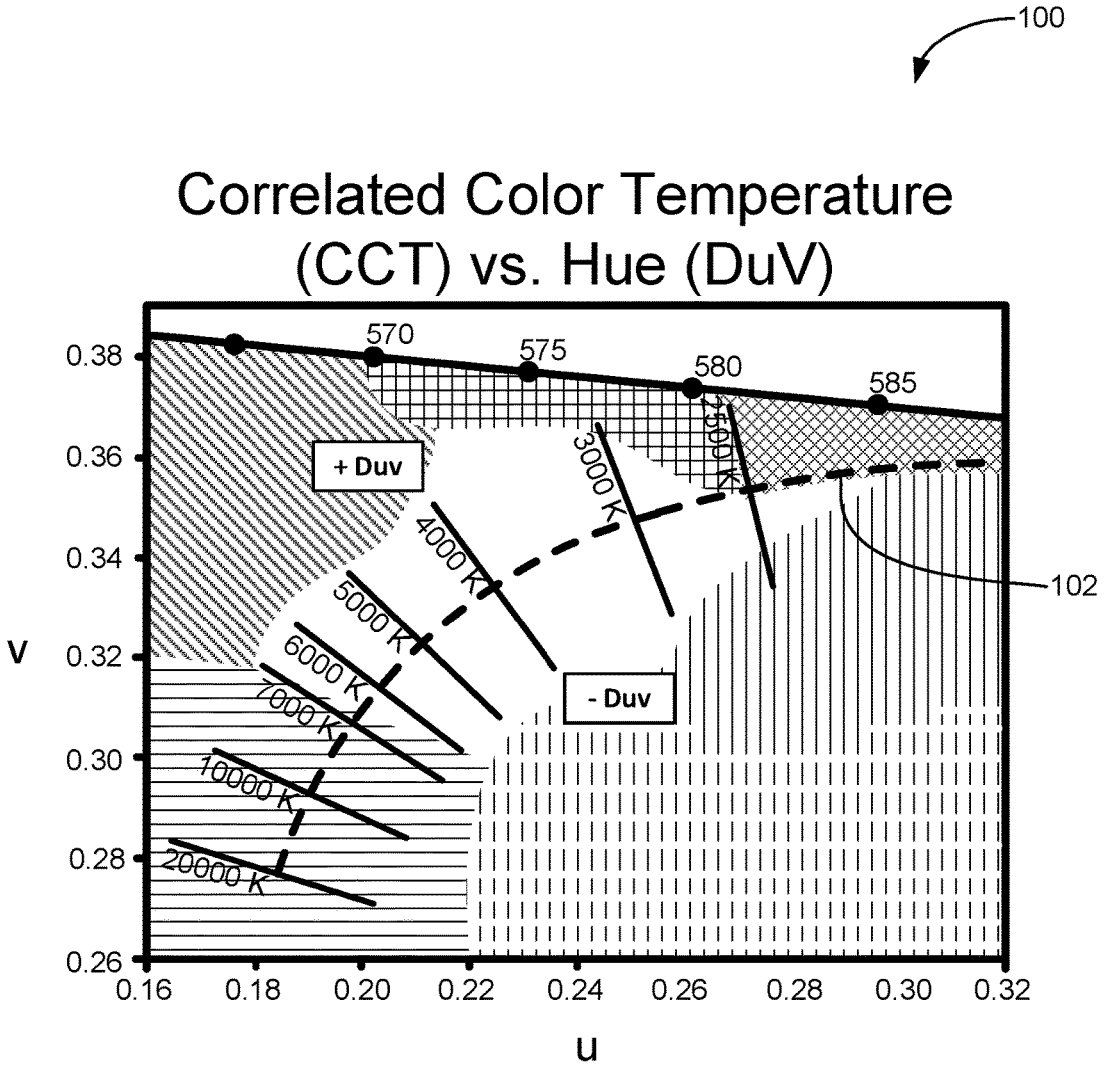
FIG. 1 illustrates an International CIE (Commission on Illumination) chromaticity diagram or mapping of human color perception.

FIG. 1 is a diagram or mapping 100 of CIE color space illustrating the human perception of color. Perceived color is mapped on the x, y graph 100, where the x-axis represents a first chrominance component (u) and the y axis represents a second chrominance component (v). The values along the x and y-axis for chromaticity (u, v) are expressed as ratios of red, green and blue (RGB) colors. As illustrated in FIG. 1, graphical symbols for representing colors in the color space are illustrated. The upper, right corner of diagram 100 includes a general area of space that is perceived as the color orange and is marked with diagonal cross-hatching. The central, upper area of diagram 100 includes a general area of space that is perceived as the color yellow and is marked with vertical and horizontal cross hatching. The upper, left corner of diagram 100 includes a general area of space that is perceived as the color green and is marked with vertical lines. The lower, left corner of diagram 100 includes a general area of space that is perceived as the color blue and is marked with horizontal lines. The lower, right corner of diagram 100 includes a general area of space that is perceived as the color purple or violet and is marked with broken vertical lines. The general area of space between the area marked as orange and the area marked as purple or violet is perceived as the color reddish pink and is marked with vertical lines. The area on diagram 100 free of graphical symbols denotes an area where light is perceived as white light. Depending on a point on the area determines whether that white light is perceived as being bluish in hue or rosier in hue. Using this chromaticity diagram or mapping 100 allows for the expression of any perceived hue or color of white light as a simple point on a unit plane and is the mechanism by which white light LEDs are sorted and binned.

In addition to CIE color space, another important value in colorimetery is color temperature or CCT (correlated color temperature). CCT is the temperature of the Planckian radiator (Planckian locus) 102, which is the path or locus that the color of an incandescent black body would take in the CIE color space. A temperature scale was developed (and is illustrated in FIG. 1) based on the emission of radiation of the black body when heated and a portion of the resulting spectra being visible light over a very high temperature range. For example, color temperatures of white light of about 2700-3000 Kelvin (K) are described as warm and occupy (as illustrated) a region on the x, y chromaticity diagram 100 with a yellowish-white or warm color of white. Color temperatures of white light of about 3500-4000 K are described as neutral white. Color temperatures of white light of about 4500-5500 K are described as a bluish white or cool color of white.

Figure 2:
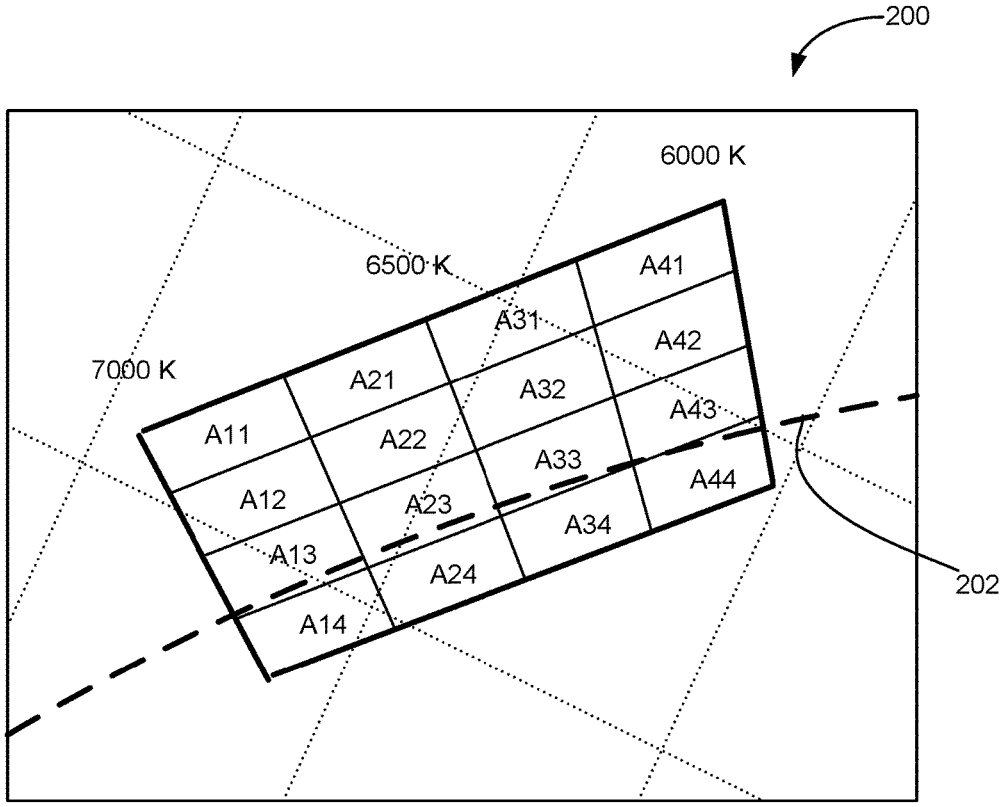
FIG. 2 illustrates ANSI (American National Standards Institute) color bins on the CIE chromaticity diagram.

FIG. 2 illustrates an example LED binning diagram 200 of bins between CCTs of 7000K and 6000K. The human eye can discern differences in color extremely well, which causes problems for LED manufacturers because when LEDs are manufactured, material process variations yield product with variation in performance. Variations in the LED manufacturing process mean individual LEDs are extremely difficult if not incapable of being made exactly alike. While LEDs can be made similar to each other, they are rarely exact. To classify LEDs, LED manufacturers have developed a system called LED binning and is based on the CIE chromaticity color space diagram 100 including the Planckian locus to offer consistent characterization of LEDs, especially white light LEDs. LEDs are tested and then binned and packaged to balance imperfections in the manufacturing process with the needs of the lighting industry. Just as traditional lamps are sold by brightness (wattage) and color (warm or cool white), LEDs are binned for brightness (luminous flux) and color parameters (chromaticity).

Binning is based on findings that the human eye cannot perceive any difference in color in certain elliptical regions of CIE diagram 100. ANSI color bins are drawn and defined as parallelograms in the white light CIE color space (indicated in FIG. 1 without graphical symbols of color) and with respect to the black body line 202 (FIG. 2) to approximate the elliptical regions (a particular color point is defined to encompass one standard deviation of a "standard observer") whose center is at the particular locus on the color plane.

In regards to LED illuminated light boxes, there are certain characteristics of the quality of light that is emitted from a light box: intensity (i.e., brightness), color temperature or CCT and deviation or hue (Duv) where u is on the x-axis and v is on the y-axis of CIE diagram 100. In addition, there are multiple light box factors that can affect these characteristics including the type of acrylic in a batch (dye, thickness and imperfections) that is used for the light panel in the light box, the mechanism used to reflect the light coming out of the light box, the distance between the LEDs, where the light escapes from the light box in an edge-lit light panel, the size of the light panel and the material or substrate used to receive the printed graphic or image that is attached to the light panel.

Figure 3:
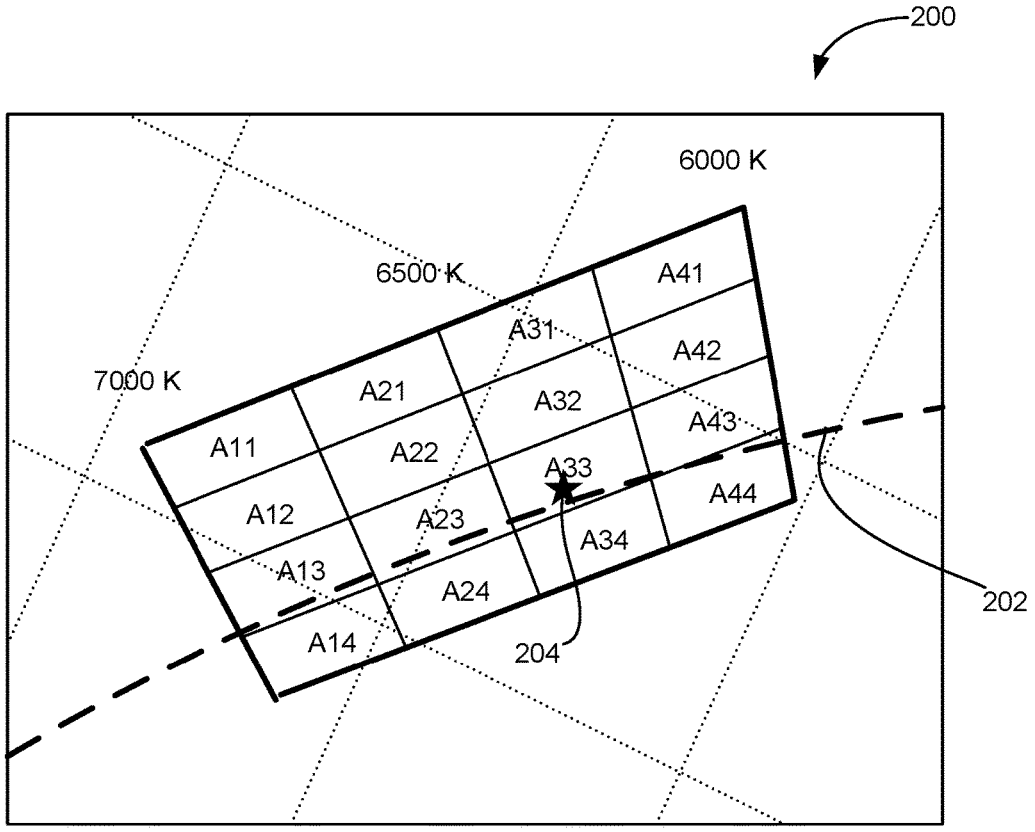
FIG. 3 illustrates a target color for emission from a light box that display graphics or images.

FIG. 3 illustrates example LED binning diagram 200 with a target color 204 for emission from a light box shown as a five pointed star on diagram 200. Target color 204 is illustrated as being located in bin A33. In light box applications, using a mix of LEDs from bin A33, however, will likely not produce target color 204 as desired because of the multiple factors listed above in regards to light boxes. More specifically, target color 204 will not be produced from simply mixing LEDs from bin A33 or other bins and mounting them in a light box. The variations in the acrylic that provides the light panel and the variations in the substrate that receives the graphic for illumination will skew the light color emitted from the light box. Likewise, if multiple light boxes are needed for an application in a retail store or other high traffic area and all of the multiple light boxes are to emit the same target color 204, such target color 204 will not be achieved in all light boxes using similar LEDs due to the variation in light box components across the multiple light boxes.

Figure 4A:
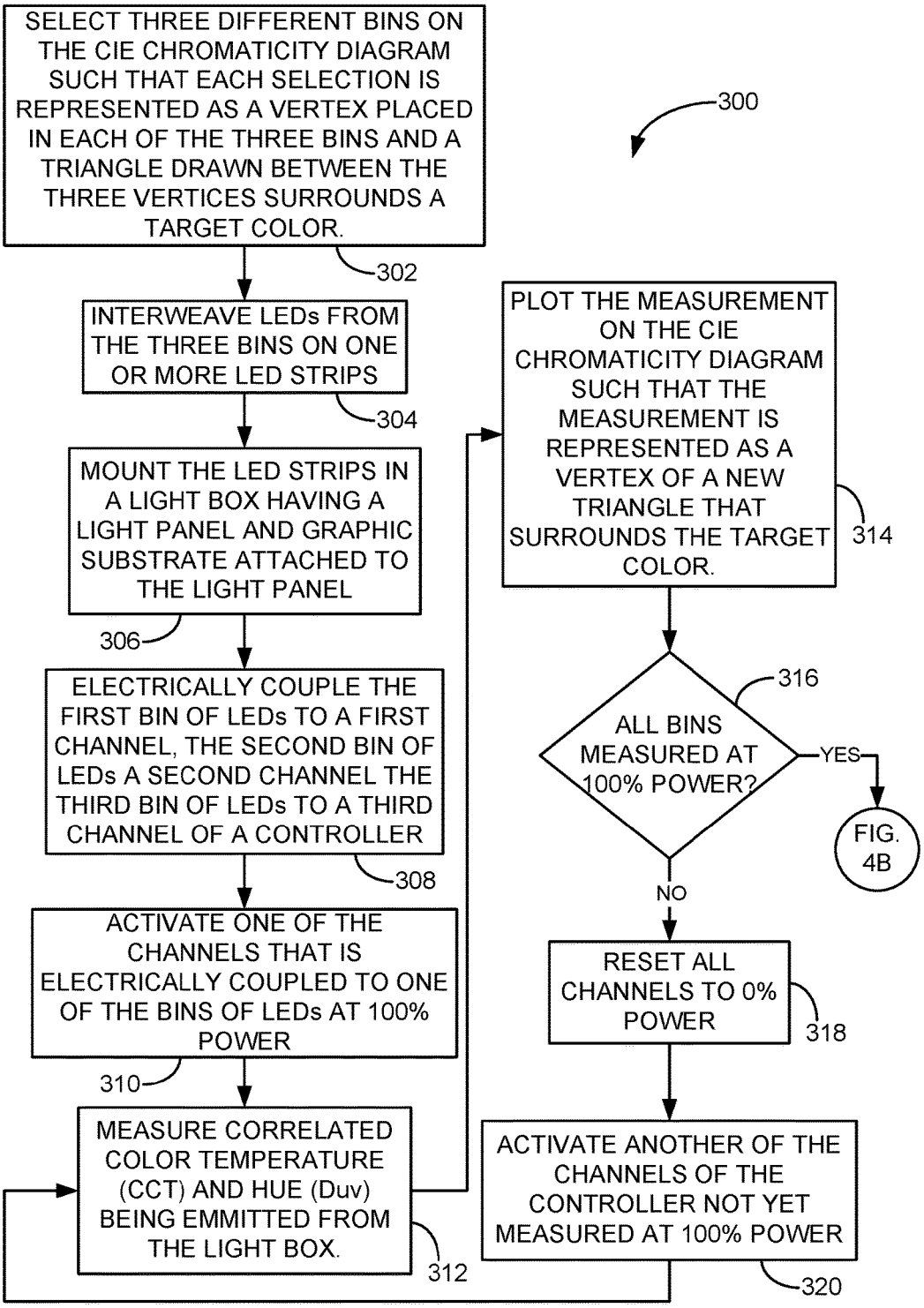
FIGS. 4A and 4B is a flowchart illustrating the process of pre-calibrating a light box so that the perceived color of light is the target color.
Figure 4B:
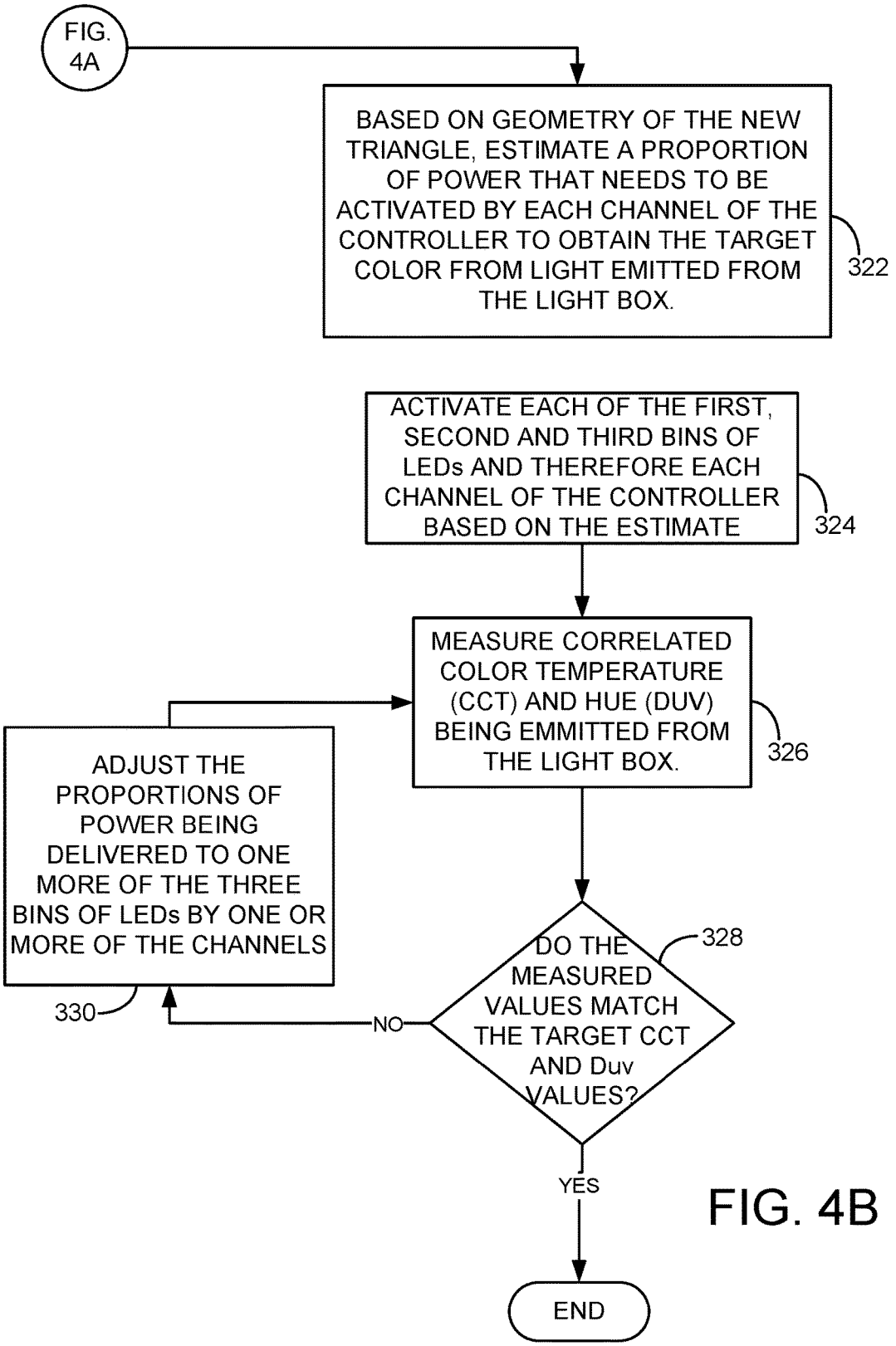
Figure 5:
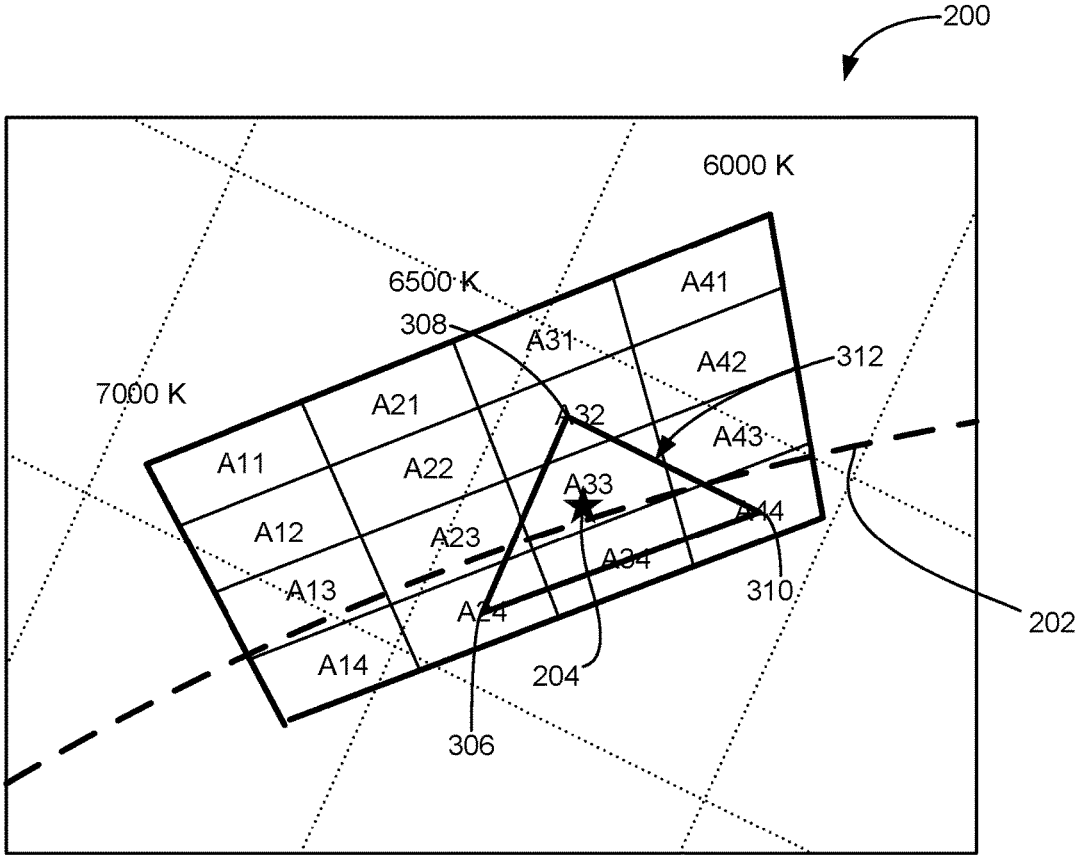
FIG. 5 illustrates a selection of a mix of LEDs from three different ANSI color bins for emission of the illustrated target color for pre-calibrating a light box according to an embodiment.

Described herein is a way to achieve uniformity of desired color quality across one or more light boxes in a particular application without having to be concerned about the filter (type of acrylic or type of material images are to be printed on) of the light box. FIGS. 4A and 4B illustrate a method 300 of pre-calibrating a light box to emit light at a target color, such as target color 204. FIG. 5 illustrates example LED binning diagram 200 with target color 204 as shown in FIG. 3, but also illustrating the first step shown in FIGS. 4A and 4B in pre-calibrating a light box to emit light at target color 204. At block 302, three different bins on CIE chromaticity diagram 200 are selected. The selected bins, such as bins A24, A32 and A44 as illustrated in the example in FIG. 5, surround target color 204. In other words each selection is representative of a point or vertex 306, 308 or 310 that is placed in each of the three selected bins. A triangle 312 is drawn between the vertices 306, 308 and 310 so that target color 204 is located inside triangle 312.

Figure 6:
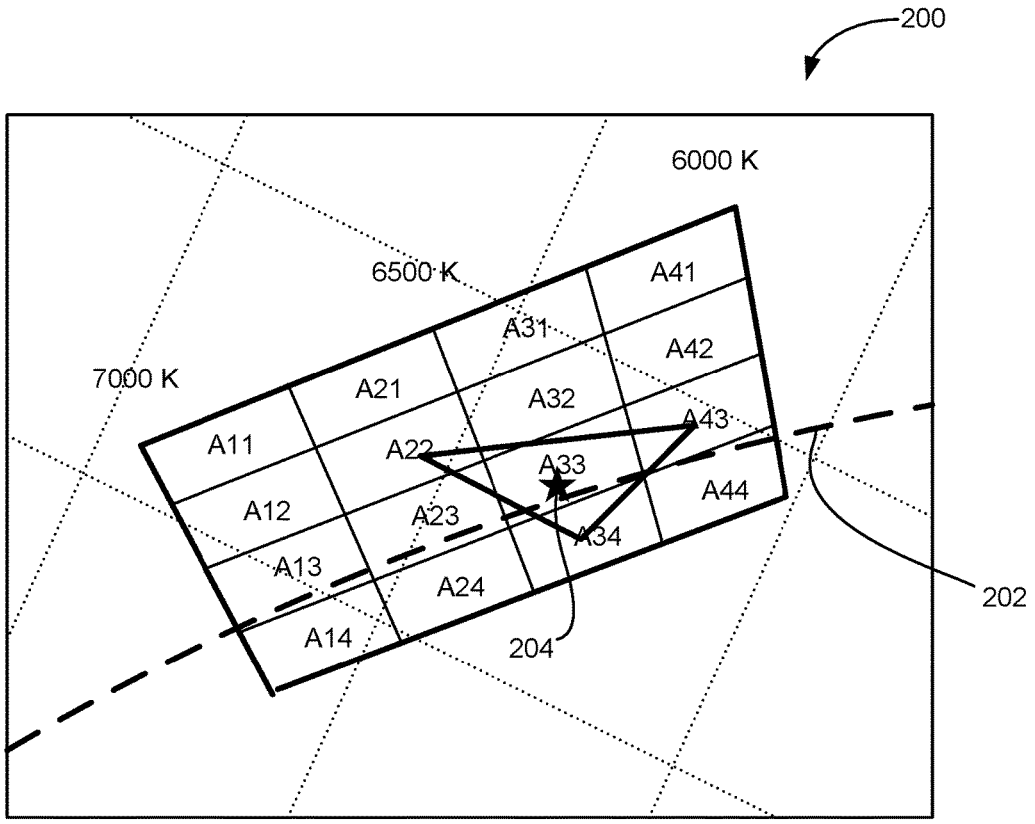
FIG. 6 illustrates a selection of a mix of LEDs from three different ANSI color bins for emission of the illustrated target color for pre-calibrating a light box according to another embodiment.
Figure 7:
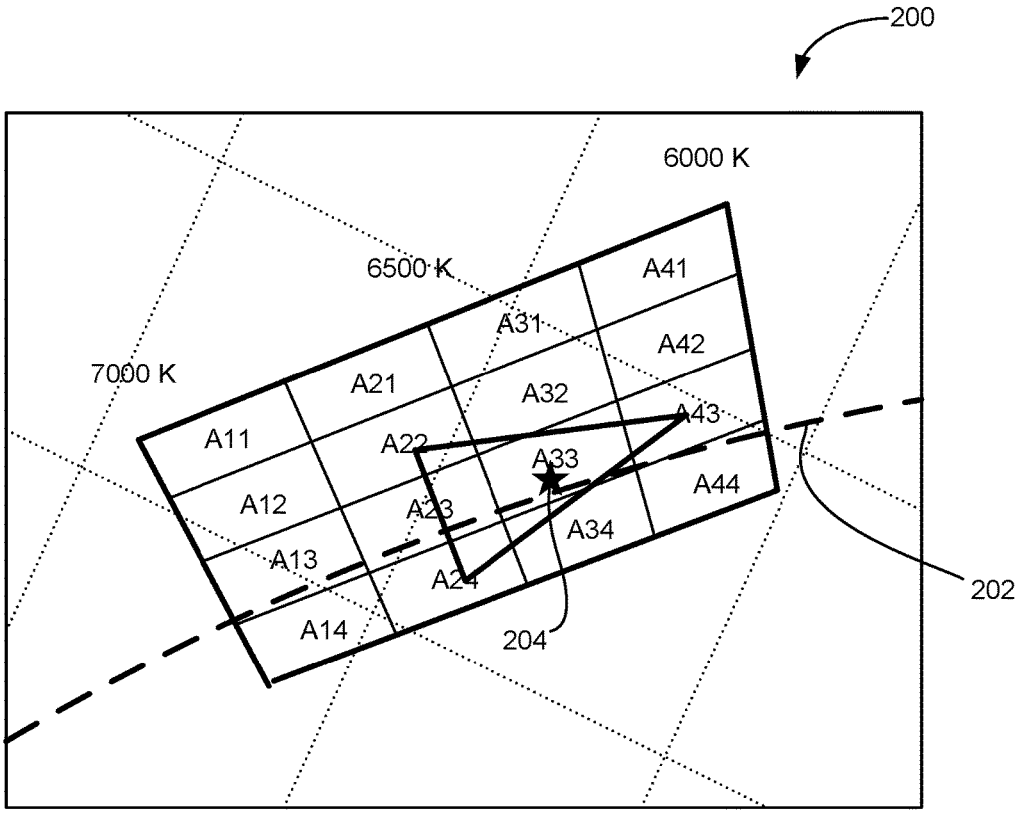
FIG. 7 illustrates a selection of a mix of LEDs from three different ANSI color bins for emission of the illustrated target color for pre-calibrating a light box according to yet another embodiment.

As illustrated in FIG. 5, two of the bins selected are located along the same axis or row (bin A24 and A44) and the third bin selected (A32) is located in a different axis or row. All bins selected A24, A32 and A44 are in different columns. While these three selections can be made for target color 204, other selections could be made where bins are selected that may or may not be in the same row and may or may not be in the same column. FIG. 6 illustrates example LED binning diagram 200 with target color 204 as shown in FIG. 3, but with a different selection of bins than the selection of bins in FIG. 5. In FIG. 6, bins A22, A34 and A43 are chosen. When the triangle is drawn, target color 204 is located within the triangle and all three bins are not in the same column or same row. FIG. 7 illustrates example LED binning diagram 200 with target color 204 as shown in FIG. 3, but with a different selection of bins than the selection of bins in either FIG. 5 or 6. In FIG. 7, bins A22, A24 and A43 are chosen. When the triangle is drawn, target color 204 is located within the triangle and bins A22 and A24 are located in the same column, but different rows and bin A43 is located in a different row and different column that the other two selections.

With reference back to FIGS. 4A and 4B, the process of pre-calibrating a light box that emits a target color proceeds to block 304 where LEDs from the three different selected bins, such as bins A24, A32 and A44, are interweaved on one or more LED strips. At block 306, the LED strips are mounted or located in the light box, which may have a light panel and graphic substrate attached to the light panel, to mix the selection of three bins of LEDs together.

Figure 8:
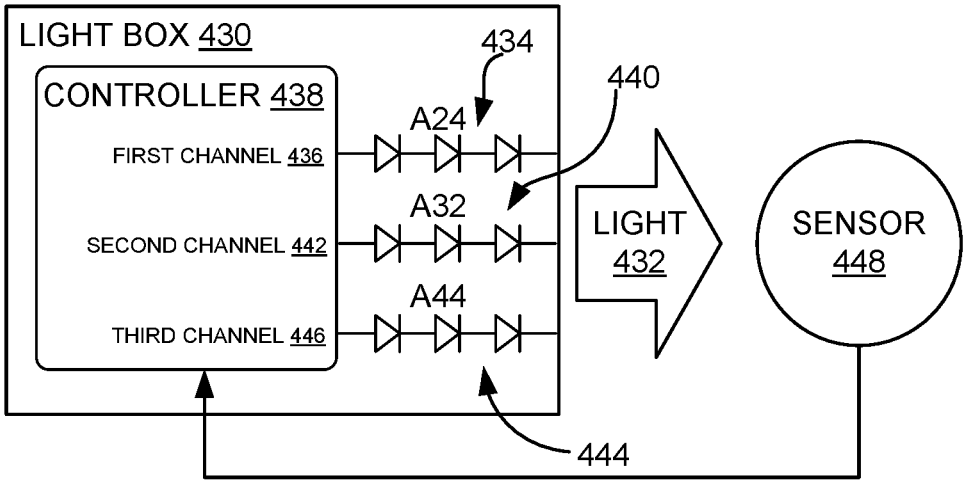
FIG. 8 is a schematic diagram of a light box that emits light through a light panel and graphic substrate according to one embodiment.

FIG. 8 illustrates a schematic diagram of a light box 430 that emits light 432 through a light panel and graphic substrate (not particularly shown). Light box 430 includes a controller 438 that has three channels 436, 442 and 446. Each channel 436, 442 and 446 drives one of the three selections of bin LEDs. At block 308, a first bin of LEDs 434, such as LEDs from bin A24, are electrically coupled to a first channel 436 of a controller 438. A second bin of LEDs 440, such as LEDs from bin A43, are electrically coupled to a second channel 442 of controller 438. A third bin of LEDs 444, such as LEDs from bin A44, are electrically coupled to a third channel 446. As previously described, LEDs from each of the three bins are interweaved on one or more light strips that are all connected to controller 438 but in such a way that each bin is electrically coupled to its own channel.

Depending on the percentage of power given to each of the channels signifies where inside the triangle drawn in for example FIG. 5 the color of the light output occurs. To determine the percentage of power needed from each of the bins of LEDs to obtain the target color, the following process is performed. At block 310, one of the three channels that is electrically coupled to one of the three bins of LEDs is activated at 100% power. One way of supplying power to each bin of LEDs is using pulse width modulation (PWM). Because microcontrollers are digital, they only have two power states: on and off. To obtain 100% power, the power state of controller 438 will be held "on." At block 312, correlated color temperature (CCT) and hue (Duv) of light 432 being emitted from light box 430 are measured by a sensor 448.

Figure 9:
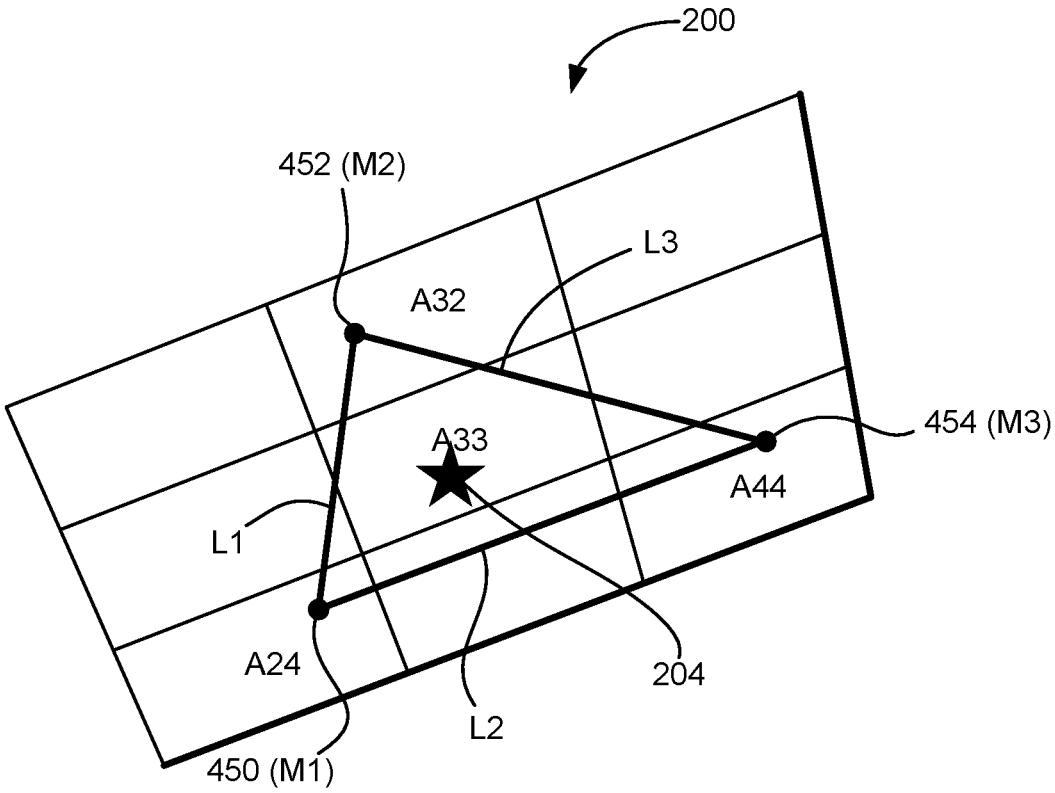
FIG. 9 is a plot of a new triangle drawn connecting sensed measurements represented as vertices for pre-calibrating a light box according to one embodiment.

At block 314, the measurement 450 as taken by sensor 448 is plotted on the CIE chromaticity diagram such that the measurements are represented as a vertex of a new triangle that is to be drawn around target color 204. For example, if the channel that is activated at 100% is first channel 436 and therefore powers the first bin of LEDs 434, which in this example is bin A24, at 100%, then depending on the LEDs in bin A24, the vertex of the new triangle may be anywhere within bin A24 as illustrated in FIG. 9 and not just in the center of bin A24. At decision block 316, it is determined whether all selected bins have been measured at 100%. Second bin of LEDs 440 and third bin of LEDs 444 have not, so the process passes to block 318 where all channels 436, 442 and 446 are reset back to "off" or 0% power.

At block 320, another of the channels that is electrically coupled to one of the three bins of LEDs is activated at 100% power. In other words, one of second channel 442 or third channel 446 is held "on." The process passes back to block 312 where correlated color temperature (CCT) and hue (Duv) of light 432 being emitted from light box 430 are measured by a sensor 448. The measurements 452 taken by sensor 448 are plotted on the CIE chromaticity diagram illustrated in FIG. 9 such that the measurements are represented as another of the vertices of the new triangle that is to be drawn around target color 204. For example, if the channel that is activated at 100% is second channel 442 and therefore powers the second bin of LEDs 440, which in this example is bin A32, at 100%, then depending on the LEDs in bin A32, the vertex of the new triangle may be anywhere within bin A32 as illustrated in FIG. 9 and not just in the center of bin A32.

At decision block 316, it is determined whether all selected bins have been measured at 100%. Third bin of LEDs 444 has not, so the process passes to block 318 where all channels 436, 442 and 446 are reset back to "off" or 0% power. At block 320, another of the channels that is electrically coupled to one of the three bins of LEDs is activated at 100% power. In other words, third channel 446 is held "on." The process passes back to block 312 where correlated color temperature (CCT) and hue (Duv) of light 432 being emitted from light box 430 are measured by a sensor 448. The measurements 454 taken by sensor 448 are plotted on the CIE chromaticity diagram illustrated in FIG. 9 such that the measurements are represented as another of the vertices of the new triangle that is to be drawn around target color 204. For example, if channel 446 is activated at 100% and therefore powers the third bin of LEDs 444, which in this example is bin A44, at 100%, then depending on the LEDs in bin A44, the vertex of the new triangle may be anywhere within bin A44 as illustrated in FIG. 9 and not just in the center of bin A44. At decision block 316, it is determined that all selected bins have been measured at 100%, so the process passes to block 322 of FIG. 4B.

At block 322, a proportion of power that needs to be activated by each channel 436, 442 and 446 of controller 438 is estimated based on the geometry of the newly drawn triangle plotted on the CIE chromaticity diagram, for example the triangle drawn on diagram 200 illustrated in FIG. 9, to obtain target color 204 from the light 432 being emitted from light box 430. The triangle drawn on diagram 200 includes three vertices 450, 452 and 454, which represent the measured values M1, M2 and M3 of CCT and Duv for each of the selected bins of LEDs at 100% power. The triangle drawn on diagram 200 also includes three legs L1, L2 and L3, which connect the three vertices together to form the triangle with target color 204 located inside the triangle.

To estimate the proportion of power from each bin of LEDs that is needed to activate each channel 436, 442 and 446 at target color 204, a first set of calculations are needed to determine a value of CCT and Duv at a point along at least two of the legs of the triangle that are closest to target color 204 and the proportions of power needed to achieve the CCT and Duv values at those points. The at least two points needed are determined by drawing the shortest lines from target color 204 to at least two different legs. The shortest line to a leg is one which intersects the leg at a 90 degree angle. In example FIG. 10, the at least two points or intersections with legs L1 and L2 are represented by C1 and C2. At point C1, the proportional distance from M1 to C1 relative to the entire length of L1 is D1 and the proportional distance from M3 to C1 relative to the entire length of L1. At point C2, the proportional distance from M1 to C2 relative to the entire length of L2 is D3 and proportional distance from M2 to C2 relative to the entire length of L2 is D4. To calculate the proportion of power of M1 and M3 to achieve C1 and the proportion of power of M1 and M2 to achieve C2 is as follows:

$$M1(D2)+M3(D1)=C1 \quad \text{(Eqn. 1)}$$

$$M1(D4)+M2(D3)=C2 \quad \text{(Eqn. 2)}$$

Figure 10:
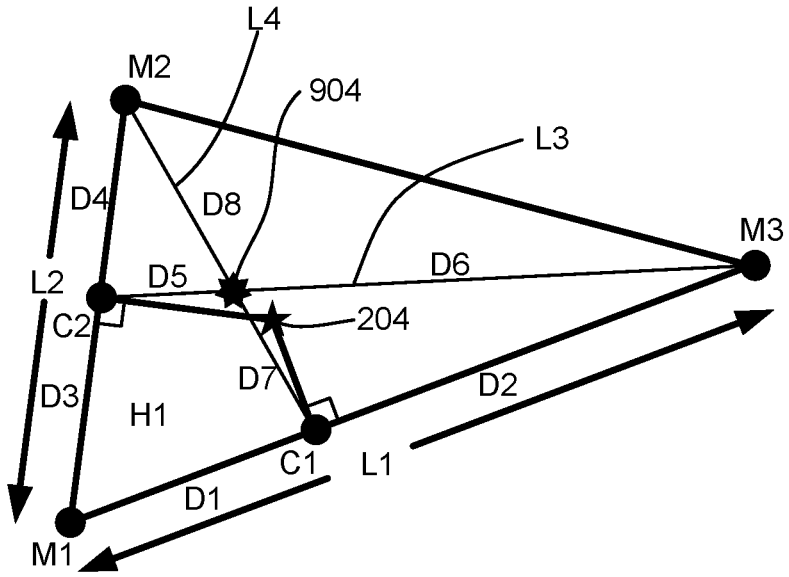
FIG. 10 illustrates a geometric calculations made to determine the proportion of power the three different bins of LEDs should be activated at to obtain the target color according to one embodiment.

In the example shown in FIG. 10 for plotting out and making these calculations, it is determined that D1=36% of L1, D2=64% of L1, D3=53% of L2 and D4=47% of L2. Given these proportional distances and given the above equations, to achieve the color at C1, the power of the bin of LEDs should be set to 64% of M1 and 36% of M3. To achieve the color at C2, the power of the bin of LEDs measured should be set to 47% of M1 and 53% of M2.

With points C1 and C2 having been calculated and plotted, lines extending from M2 to C1 and M3 to C2 may be drawn. Those lines will come close to intersecting at target color 204. For example and as illustrated in FIG. 10, a line L3 extending from C2 to M3 is drawn and a line L4 extending from C1 to M2 is drawn. Where the two lines intersect is a point 904 within the triangle where proportions of power needed to achieve CCT and Duv values are possible to determine. The point 904 of intersection will also break each line L3 and L4 into two different line segments with proportional distances relative to the entire length of each line L3 and L4. In particular, at point 904, the proportional distance from C2 to 904 relative to the entire length of L3 is D5 and the proportional distance from M3 to 904 relative to the entire length of L3 is D6. In addition, at point 904, the proportional distance from C1 to 904 relative to the entire length of L4 is D7 and the proportional distance from M2 to 904 relative to the entire length of L4 is D8. To calculate the proportion of power of C2 and M3 to achieve 904 and the proportion of power of C1 and M2 to achieve 904 is as follows:

$$C2(D6)+M3(D5)=\text{point 904}=\text{estimate of target color 204} \quad \text{(Eqn. 3)}$$

or $$C1(D8)+M2(D7)=\text{point 904}=\text{estimate of target color 204} \quad \text{(Eqn. 4)}$$

However, the calculation for point 904 needs to be in terms of M1, M2 and M3 because these are the vertices of the triangle that represent the three bins of LEDs to which channels 436, 442 and 446, respectively, are electrically coupled to. Therefore, equations 2 and 3 or equations 1 and 4 should be combined to achieve the proportions of M1, M2 and M3 for point 904. The following is an example of combining equations 2 and 3:

$$[M1(D4)+M2(D3)](D6)+M3(D5)=\text{point 904} \quad \text{(Eqn. 5)}$$

or $$M1(D4)(D6)+M2(D3)(D6)+M3(D5) \quad \text{(Eqn. 6)}$$

In the example shown in FIG. 9 for plotting out and making calculations, it is determined that D3=53% of L2, D4 is 47% of L2, D5 is 21% of L3 and D6 is 79% of L3. Given these proportional distances and given equation 5, to achieve the color at point 904, the power of the bin of LEDs should be set to be 37% of M1 because 0.47 times 0.79 is 0.37 or 37%, 42% of M2 because 0.53 times 0.79 is 0.42 or 42% and 21% of M3.

To "simulate" these fractions of power suppled to each bin of LEDs, the output of controller 438 is oscillated. For example, an LED or LEDs turned on for 50% and off for 50% will have half as much power and be half as bright since the total light output over the time duration is only half as much as 100% on. Duty-cycle refers to the total amount of time a pulse is on over the duration of the cycle. Given the values calculated above and in block 322, at block 324, each of the first, second and third bins of LEDS and therefore each channel 438, 442 and 446 should be activated based on these estimated proportions of power. In particular, first channel 438 is activated at 37% duty cycle, second channel 442 is activated at 42% duty cycle and third channel 446 is activated at 21% duty cycle. These activated channels at these proportioned values will produce an estimate of target color 204.

At block 326, sensor 448 measures the CCT and Duv of light 432 being emitted from light box 430 at the estimated proportions of power. At block 328, it is determined if the measured values match the CCT and Duv values of target value 204. Likely, they will not because the proportions of power were estimates. If not, the process proceeds to block 330 where the proportions of power being delivered to the three bins of LEDs by the three channels are adjusted based on empirical information. Blocks 326, 328 and 330 are repeated until target color 204 is achieved.

Upon achievement of target color 204, another reading is taken of brightness in unit of foot candles or lux and the reading is compared to a target brightness. All of the proportioned power being activated by controller 438 to channels 438, 442 and 446 are either all reduced or increased based on the percentage difference between the measured brightness and the target brightness. Light box 430 is now ready for placement in a retail store without any further adjustments to be made in the field.

Tuning each of the three selection of bin LEDs in light box 430 by changing the power or brightness of the LEDs is a much more efficient process than selecting different bins of LEDs for different light boxes to gain uniformity in each of the light boxes in a given application. In other words, different batches of acrylic, different material used for printing the graphic and changes to sizes of acrylic may be used in any given application, but here, the same selection and manufacture of bin LEDs can be used. All that needs to be done in manufacturing is tuning the mix of LEDs to the desired quality using the process and structure described above.

Although the present invention has been described with reference to preferred embodiments, workers skilled in the art will recognize that changes may be made in form and detail without departing from the spirit and scope of the invention.

What is claimed is:

1. A method of pre-calibrating a light box to emit a target color of white light, the method comprising:

selecting a plurality of white LEDs from three different color bins on a chromaticity diagram such that each selection is based on plotting a representative vertex in each of the three color bins and drawing a triangle between the three vertices so that a target color of white light to be emitted from the light box is located inside the plotted triangle;

using the selected plurality of white LEDs from the three different color bins inside the light box; and supplying a proportion of power to each of the first, second and third color bins of white LEDs as determined by the location of the target color of white light with respect to a location of each of the selected first, second and third color bins on the chromaticity diagram, wherein supplying the proportion of power comprises:

activating the first color bin of white LEDs at 100% power while keeping the second and the third color bins at 0% power;

measuring correlated color temperature (CCT) and hue (Duv) of white light being emitted from the light box by the first color bin;

activating the second color bin of white LEDs at 100% power while keeping the first and the third color bins at 0% power;

measuring CCT and hue of white light being emitted from the light box by the second color bin;

activating the third color bin of white LEDs at 100% power while keeping the first and the second color bins at 0% power;

measuring CCT and hue of white light being emitted from the light box by the third color bin; and replotting the CCT and the hue for each of the three measurements on the chromaticity diagram and drawing a new triangle where the target color of white light remains located inside the new triangle.

2. The method of claim 1, wherein using the selected plurality of white LEDs from the three different color bins inside the light box comprising providing at least one LED strip inside the light box that includes the white LEDs from the three different color bins and the white LEDs from the three different color bins are interweaved along the LED strip.

3. The method of claim 1, wherein the plurality of white LEDs selected from the three different color bins are electrically coupled to a controller having a first channel for activating white LEDs from the first color bin, a second channel for activating white LEDs from the second color bin and a third channel for activating white LEDs from the third color bin.

4. The method of claim 1, wherein supplying the proportion of power further comprises estimating a proportion of power that needs to power each of the first, second and third color bins based on calculating geometry of the new triangle.

5. The method of claim 4, wherein calculating geometry of the new triangle comprises:

determining proportional power of the first and second color bins of white LEDs at a point along a first leg of the new triangle that is closest to the target color of white light, wherein the first leg connects the vertices that are representative of the first and second color bins;

determining proportional power of the first and third color bins of white LEDs at a point along a second leg of the new triangle that is closest to the target color white light, wherein the second leg connects the vertices that are representative of the first and third color bins;

drawing a first line between the point along the first leg of the new triangle and an opposing vertex of the new triangle;

drawing a second line between the point along the second leg of the new triangle and an opposing vertex of the new triangle such that the second line intersects with the first line at an estimated point of the target color of white light; and determining proportional power of the three color bins of white light at the estimated point.

6. The method of claim 5, further comprising activating each of the first, the second and the third color bins of white LEDs based on the determination of proportional power of the three color bins of white light at the estimated point.

7. The method of claim 6, further comprising measuring CCT and hue being emitted from the light box at the determined proportional power of the three color bins of white light at the estimated point.

8. The method of claim 7, further comprising empirically adjusting the proportions of power of the three color bins of white light until the measured CCT and hue being emitted from the light box matches the target color.

* * * * *